US006193168B1

(12) United States Patent
Bedford

(10) Patent No.: US 6,193,168 B1
(45) Date of Patent: Feb. 27, 2001

(54) SPRINKLER DEVICE

(76) Inventor: William L. Bedford, 14310 Briarbend, San Antonio, TX (US) 78147

( * ) Notice: Subject to any disclaimer, the term of this patent is extended or adjusted under 35 U.S.C. 154(b) by 0 days.

(21) Appl. No.: 09/412,725

(22) Filed: Oct. 5, 1999

(51) Int. Cl.[7] ..... B05B 15/10
(52) U.S. Cl. ..... 239/204; 239/205; 239/600
(58) Field of Search ..... 239/200–5, 280, 239/533.15, 600; 285/5, 148.23, 148.22, 148.18, 390

(56) References Cited

U.S. PATENT DOCUMENTS

| | | | | |
|---|---|---|---|---|
| D. 241,249 | | 8/1976 | Elek . | |
| 1,833,040 | | 11/1931 | Rader . | |
| 2,968,440 | | 1/1961 | Cone . | |
| 3,084,869 | | 4/1963 | Hutty et al. . | |
| 3,776,463 | * | 12/1973 | Dyck | 239/204 |
| 3,825,186 | | 7/1974 | Heenan et al. . | |
| 4,003,520 | * | 1/1977 | Bailey | 239/205 |
| 4,274,592 | | 6/1981 | Westhusin . | |
| 4,391,005 | * | 7/1983 | Goettl | 4/490 |
| 4,939,797 | * | 7/1990 | Goettl | 4/490 |
| 4,955,543 | * | 9/1990 | Orth et al. | 239/284.2 |
| 5,004,157 | * | 4/1991 | Martell | 239/205 |
| 5,141,255 | | 8/1992 | Hanaoka . | |
| 5,335,857 | * | 8/1994 | Hagon | 239/204 |

* cited by examiner

*Primary Examiner*—Lesley D. Morris
(74) *Attorney, Agent, or Firm*—Jackson Walker L.L.P.

(57) ABSTRACT

A kit for fitting to a sprinkler head that includes a fixed distance spacer. The spacer is designed to fit into the top of the head of an underground water sprinkler system. The second end of the spacer will threadably engage the stem. The spacer will raise the stem above the top of the head, so as to not require digging to get to the base of the head. In this way, when the grass grows or the level of the soil is elevated, one may raise the level of the stem by putting a spacer between the stem and the head, without having to dig.

6 Claims, 11 Drawing Sheets

SPRINKLER DEVICE

FIELD OF THE INVENTION

The present invention relates to a water sprinkler device, more particularly a spacer kit to fit between the riser and head of a sprinkler.

BACKGROUND OF THE INVENTION

In-ground lawn sprinklers are used to distribute water to a lawn. They are typically fed from an underground water line from which a vertical extension riser is attached. Attached to the riser is the head of the sprinkler, the sprinkler head having attached at its uppermost portion a stem that typically includes an extending member having a nozzle that can extend, under water pressure, to spray the lawn.

For proper watering, it is important to maintain the sprinkler head at the proper level with respect to the lawn. After the sprinkler system is installed, the lawn may rise, as mulch or new soil is added. Raising the sprinkler is typically done by adjusting the length of the riser pipe or adding extensions between the riser and the head. However, because the sprinkler head/riser joint is well below the level of the stem, which is typically at or near the grass level, digging is often required to effect this extension.

In the past, others, such as Rainbird, have provided a 6" stem member extension threaded internally at one end and externally at the other. This 6" extension is designed to fit where the nozzle of the extendable stem member screws into the top of the extendable stem member. The nozzle is unscrewed and the 6" extender is screwed into where the nozzle was originally screwed (the top of the extendable stem member). The nozzle is then threaded into the removed end of the extension to give a 6" rise to the nozzle as it sits above the cap of the stem. However, this 6" extension often stands above the surrounding grass and is in danger of being damaged by lawnmowers. Further, it prevents complete retraction of the nozzle into the head body. That is, even with the stem member in a retracted position (no water pressure in the head), the 6" extension raises the nozzle 6" above the stem cap.

What is needed is a simple, inexpensive, and heretofore unavailable means to elevate the stem of the sprinkler above the head body so as to increase the height of the stem above the head body to adjust the height of the stem so it is proper with respect to the ground around it.

OBJECTS OF THE INVENTION

It is an object of the present invention to provide a retrofittable sprinkler stem/head spacer which will, when installed, allow the sprinkler head to function just as it would without the spacer—that is, it will allow the extension and retraction of a sprinkler head portion above the sprinkler head when water pressure is applied and released to the sprinkler head.

It is another object of the present invention to provide a simple cylindrical spacer that will thread into the sprinkler head body and insert to fit into the sprinkler head body to create a space between the stem cap and the sprinkler head body, but will allow normal extension and retraction of the sprinkler stem member under use.

SUMMARY OF THE INVENTION

These and other objects are realized in a cylindrical spacer having a first end and a second end, the first end for threading into the head body of a sprinkler and the second end for threading into the stem of a sprinkler, and an insert fittable inside the cylindrical spacer to guide the extensible stem of the sprinkler head as it moves between a retracted nonuse position and an extended use position.

BRIEF DESCRIPTION OF THE DRAWINGS

FIGS. 2A',2B',2C',2D' and 2E' are perspective, side cross section, top, bottom, and side elevational views, respectively, of a alternate preferred embodiment of an insert for use with Applicant's present invention.

FIG. 3' is an exploded view of a spacer and a preferred embodiment of the insert of the present invention as it joins the sprinkler body and sprinkler head stem to elevate the stem of the sprinkler above the sprinkler head body.

FIG. 3A' is a cutaway side cross sectional view of Applicant's spacer and a preferred embodiment of Applicant's insert installed on a sprinkler head body.

FIG. 5' is a side elevational view of a multiplicity of preferred embodiments of Applicant's inserts stacked together for insertion into the spacers of FIG. 4.

DETAILED DESCRIPTION OF THE PREFERRED EMBODIMENT

Figure 1B:
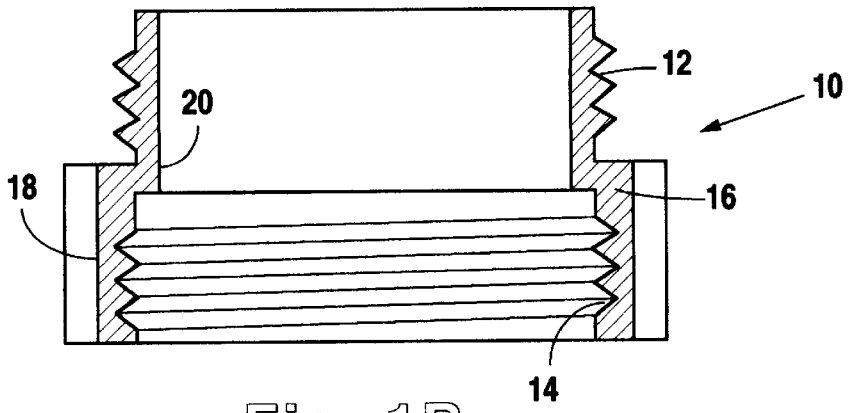
FIGS. 1A, 1B, and 1C are side perspective, side cross section, and top elevational views, respectively, of the cylindrical spacer of the present invention.
Figure 1A:
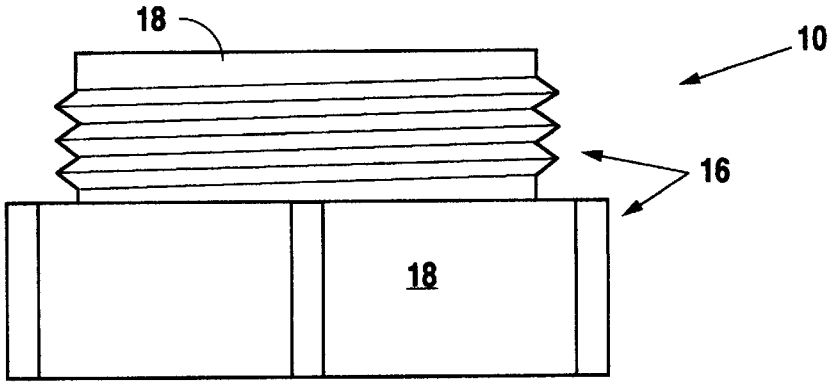
Figure 1C:
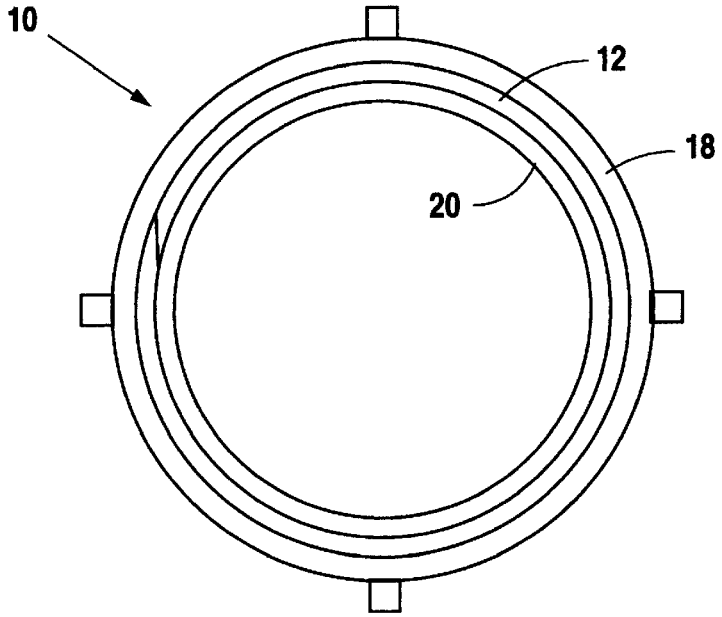

FIGS. 1A, 1B, and 1C illustrate a cylindrical spacer (10) of Applicant's present invention which is seen to be comprised of a threaded first end (12) (threads on the outer surface) and a threaded second end (14) (threads on the inner surface) with a body (16) therebetween. The cylindrical spacer (10) is seen to have an outer surface (18) and an inner surface (20). The first end (12) has threads on the outer surface to match the threads of a sprinkler head stem cap. The second end (14) has threads on the interior surface to engage a head body of the sprinkler. The threads on first end (12) and second end (14) are typically molded to fit most pop-up head type sprinklers, such as Rainbird, Hunter, Hardy, Toro, Richdel, and others. The spacers may also be designed to fit rotary head sprinklers.

Figure 3:
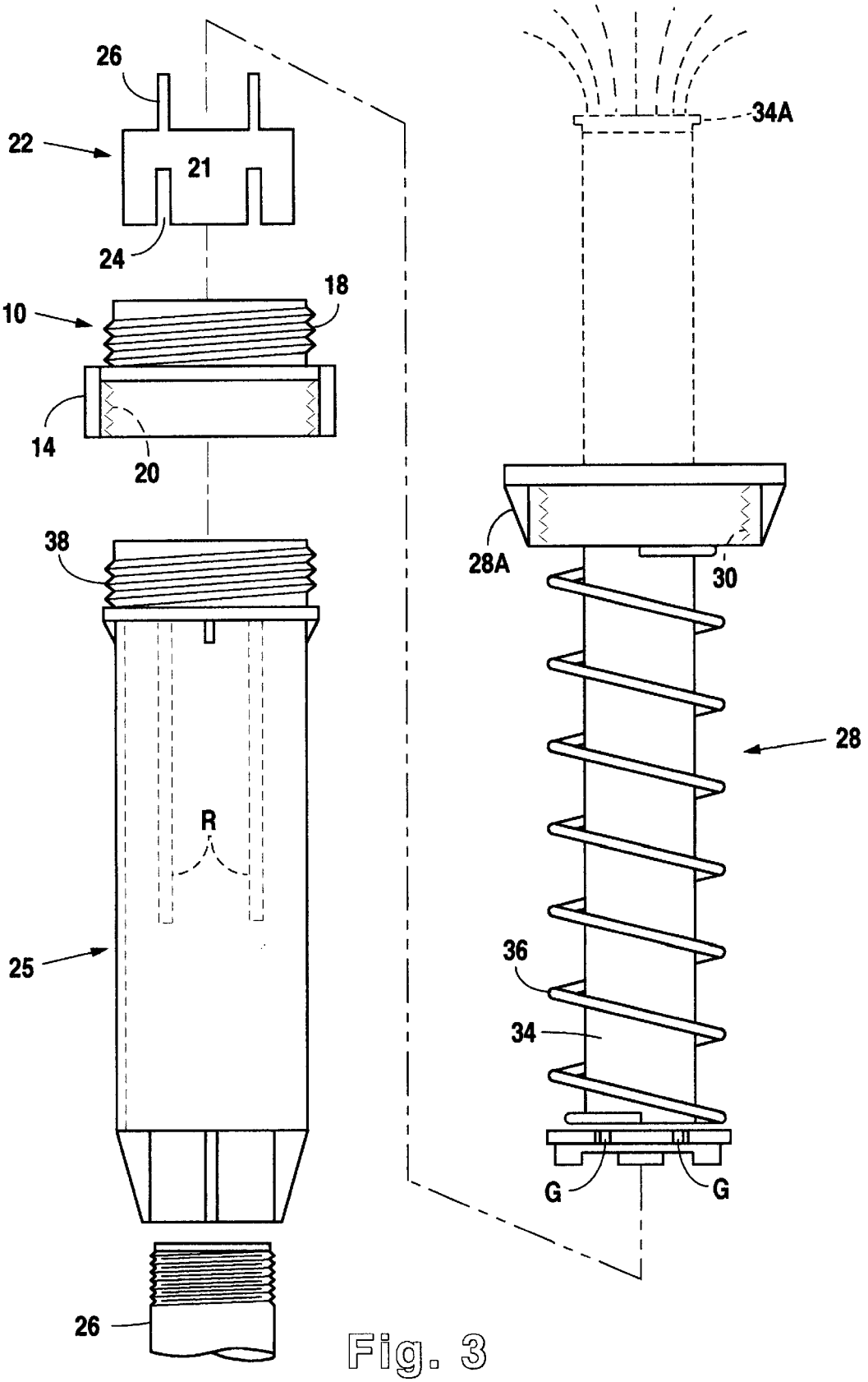
FIG. 3 is a exploded view of a spacer and insert of the present invention as it joins a sprinkler head body and sprinkler head stem to elevate the stem of the sprinkler above the sprinkler head body.
Figure 3:
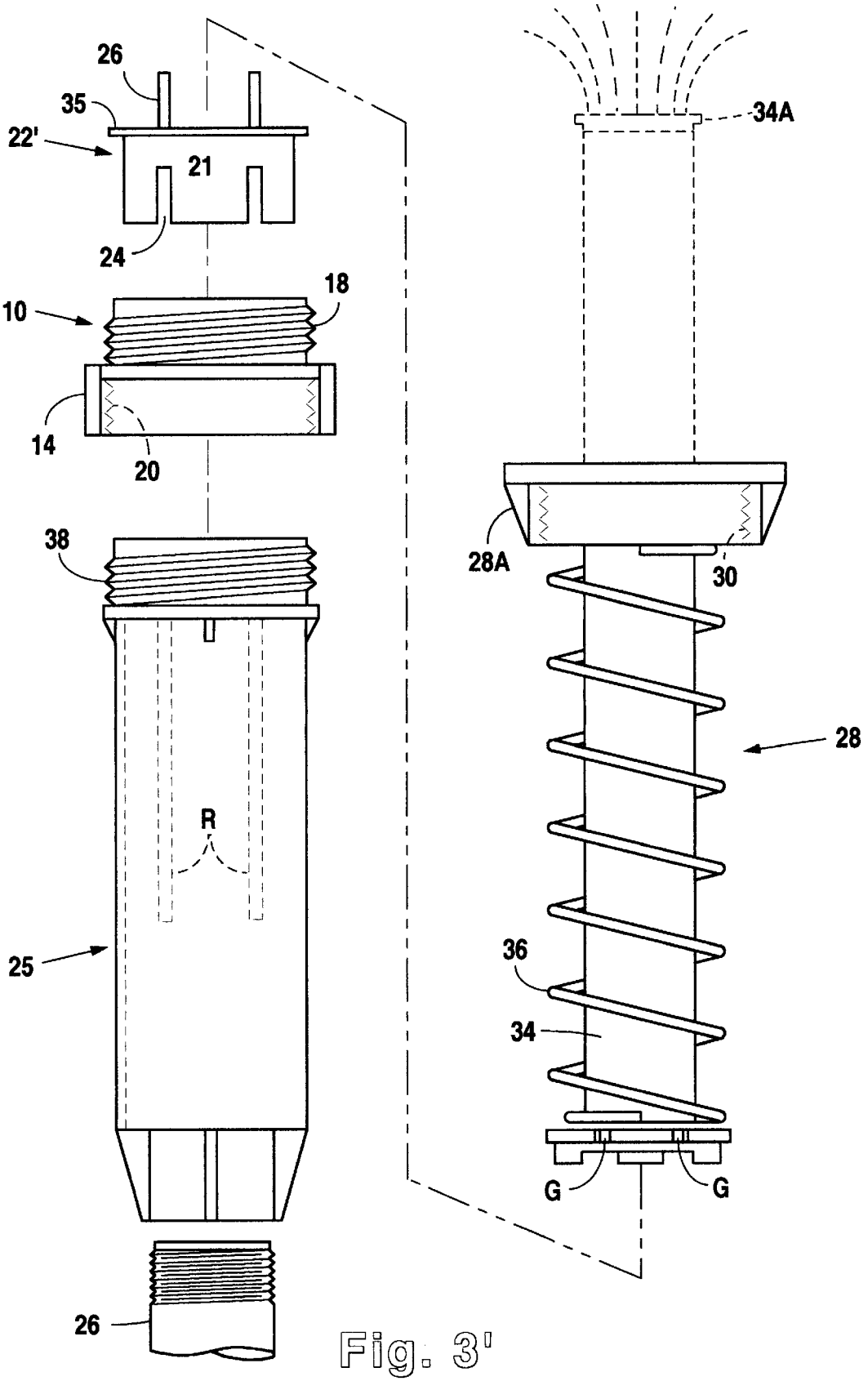

By inserting spacer (10) between the head body and the stem cap of the sprinkler, as set forth in FIG. 3, the stem is elevated to meet the surface of the ground to help the sprinkler more effectively water the ground. By placement of spacer (10) between the head body and the stem of the sprinkler rather than between the head and the riser pipe or water line, no digging will be required.

In many sprinkler head bodies, a longitudinally running ridge (or ridges) is used to maintain alignment of the pop-up stem member of the sprinkler head stem as it moves between a retracted and extended position when water pressure is applied and released. These are illustrated as (R) in FIG. 3 and mate with grooves (G) of the stem when the stem is inserted into the head body. On such sprinkler types, for example the Rainbird sprinkler, an insert (22) is used. With reference to FIGS. 2A–2E, insert (22) is seen to be cylindrical having an insert body (21), grooves (24) on a lower end thereof, and guide ridges (26) along an upper portion thereof. By sliding the insert (22) so that the grooves (24) fit the alignment ridges on the inner surface of the cylinder, guide ridges (26) will align with the alignment ridges of the inner surface of the head (see also FIG. 3) so the stem member can be guided as it extends upward, under water pressure, the additional distance provided by the spacer(s) and insert(s).

FIG. 3 illustrates an exploded view of the use of Applicant's spacer (10) and (optionally, as required) insert (22) on a sprinkler head. The environment in which Applicant's invention is utilized is described as follows. A sprinkler head consisting of a head body (25) and sprinkler stem (28) of a preexisting sprinkler to be retrofitted with Applicant's spacer (10) and guide (22) is illustrated in FIG. 3. Here, head body (25) is seen to extend upward from an existing riser or water line (26) which supplies water, under pressure, to the head body (25) of the sprinkler. The preexisting sprinkler head stem (28) has a cap (28A) with threads (30) on the interior surface thereof. The stem also includes a stem extensible means (32), here including a stem member (34) and a spring (36). The stem member is either extended (shown in FIG. 3) when water is on or retracted (also shown in FIG. 3) when water is off. FIG. 3 shows the stem member in both positions at once, only for the sake of illustration. A top portion of the stem (34) has a nozzle (34A) from which point water is released to wet the lawn. Such extensible means (32) are available with a number of well-known sprinkler manufacturers, but most utilize movement of extensible means (32) from a retracted position to an extended position (when water pressure is applied through the water supply line or riser). In the extended position, the stem will distribute water to the lawn. In a retracted position (nonwatering), it retracts to within the body of the sprinkler.

Figure 2A:
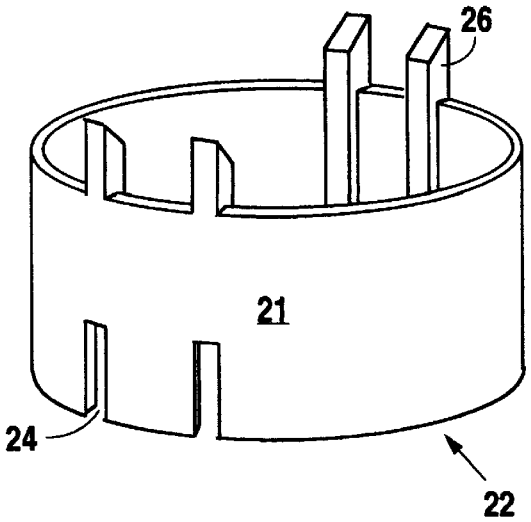
FIG. 2A is a perspective view of an insert used with an alternate preferred embodiment of the present invention.
Figure 2B:
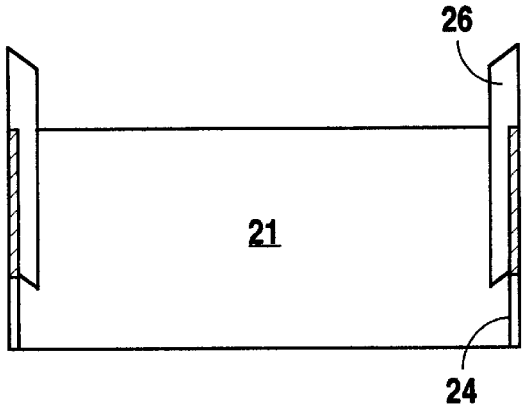
FIGS. 2B, 2C, 2D and 2E are side cross section, top, bottom, and side elevational views, respectively, of an insert for use with Applicant's present invention.
Figure 2C:
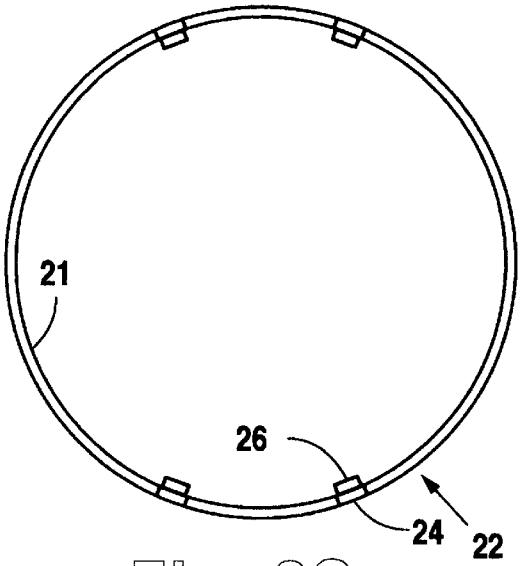
Figure 2D:
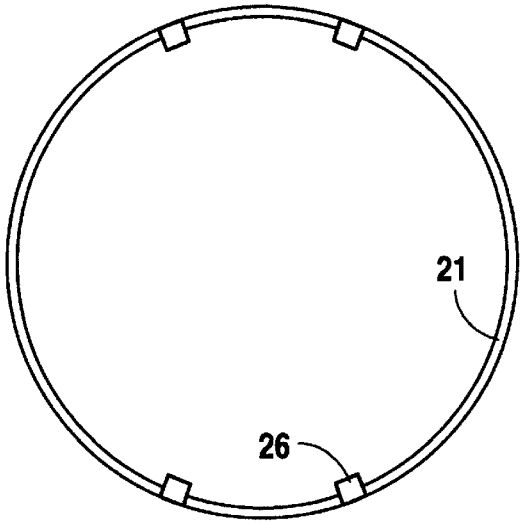
Figure 2E:
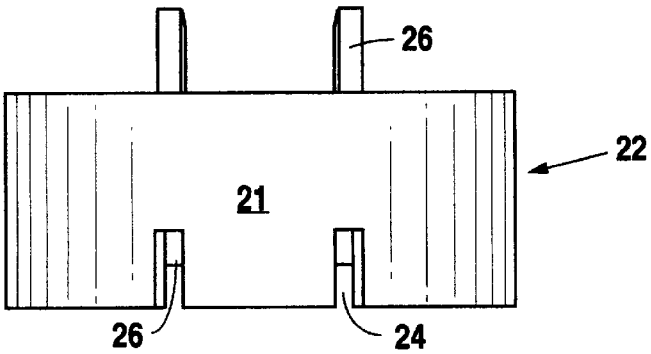
Figure 2A:
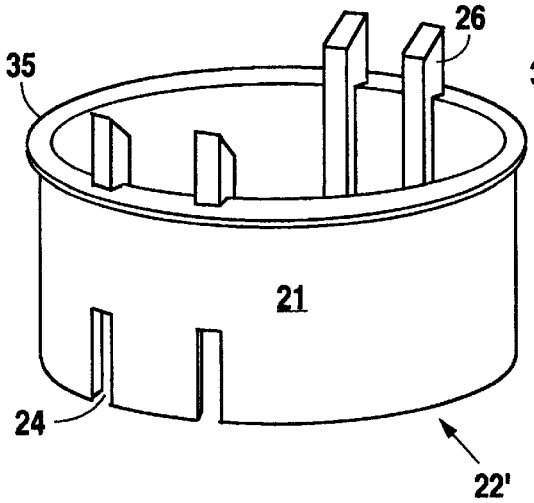
Figure 2B:
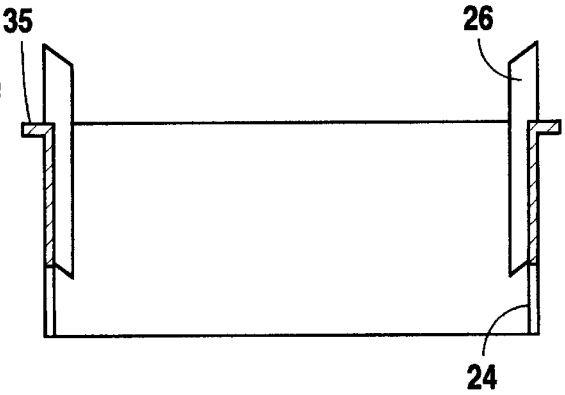
Figure 2C:
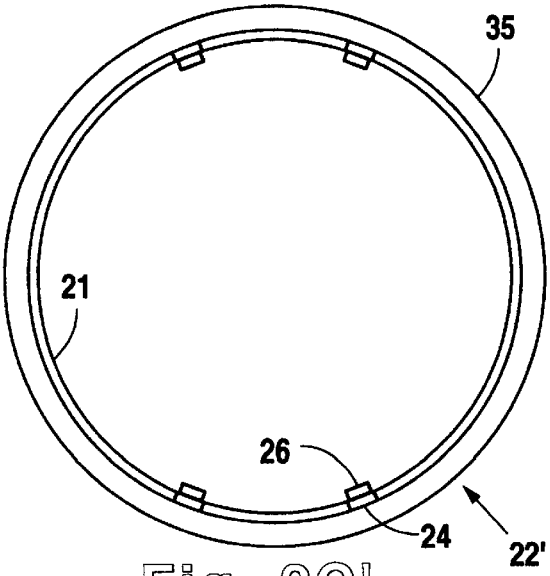
Figure 2D:
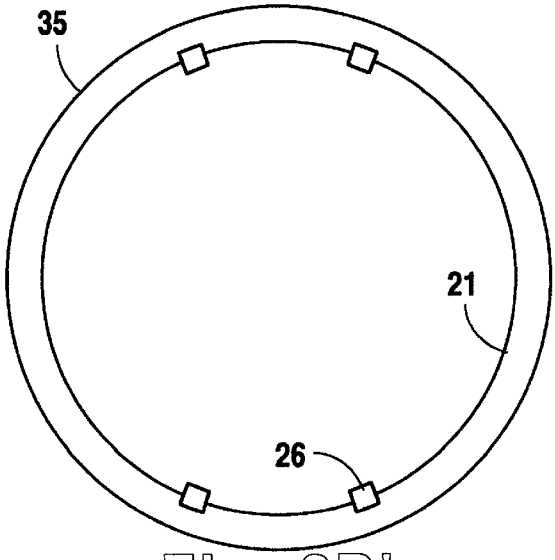
Figure 2E:
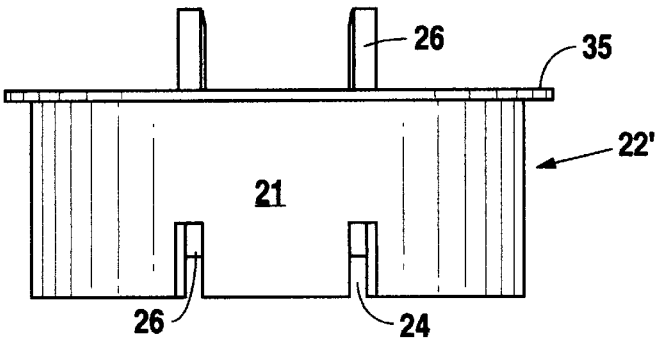
Figure 3A:
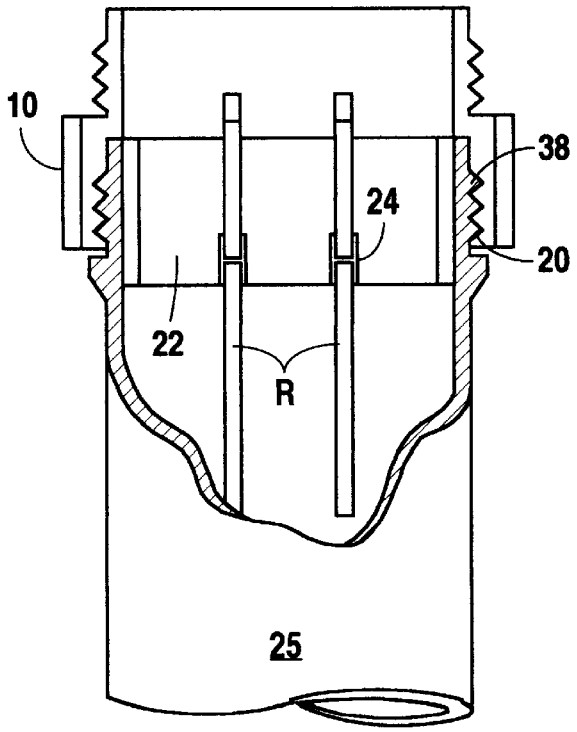
FIG. 3A is a cutaway side cross sectional view of Applicant's spacer and insert installed on a sprinkler head body.

Continuing now with FIGS. 3 and 3A, and with reference to FIGS. 1A–1C and 2A–2E, it is seen that the threaded first end (18) of the spacer is insertable to engage threads (30) of the stem cap. Threaded second end (14) of the spacer is designed to threadably engage threads (38) on the outer surface of the upper portion of the head body of the sprinkler (or to threadably stack with other spacers as set forth in FIG. 4). The spacer is threaded down to the body to effect a water-tight seal between threads (38) and threads on the inner surface (20) of second end (14) where the spacer joins the head body (25). Likewise, there should be a water-tight seal between threads (30) of the stem cap and threads on the outer surface (18) of threaded first end (12) of the spacer (10). Insert (22) or other alignment means may be inserted into the upper portion of head body (25) to, for example, allow alignment of stem member (32) with ridges (R) on the inner surface of the body. This is done through mating and alignment of grooves (24) of insert (22) with ridges (R) of the body.

FIG. 3A illustrates the proper alignment of guide insert (22) with alignment ridges (R) of head body (25) mating with grooves (24) when spacer (10) is installed. Note how insert (22) is dimensioned with a proper diameter to snugly fit within the interior of body (25).

Figure 5:
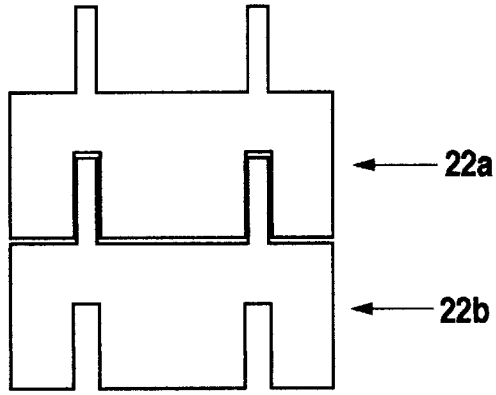
FIG. 5 is a side elevational view of a multiplicity of inserts stacked together for insertion into the spacers of FIG. 4.
Figure 4:
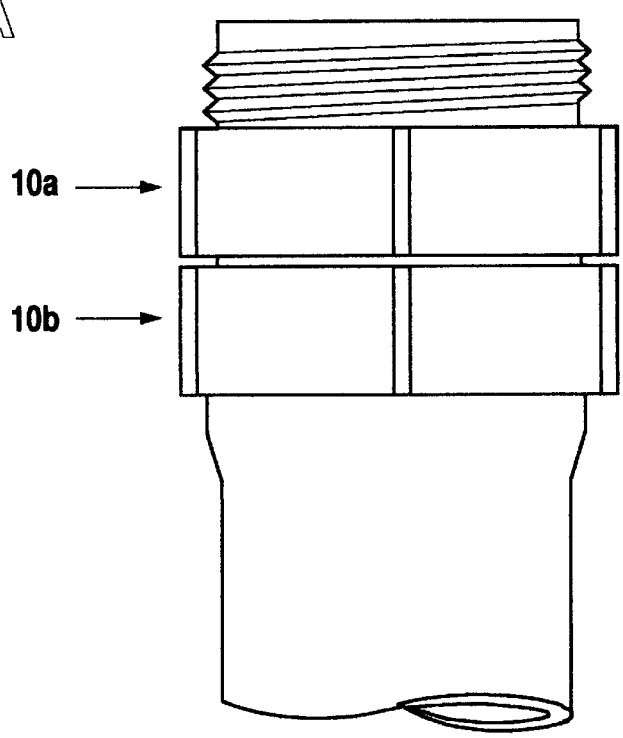
FIG. 4 is a side elevational view of a multiplicity of spacers threaded together and into a sprinkler head body.
Figure 3A:
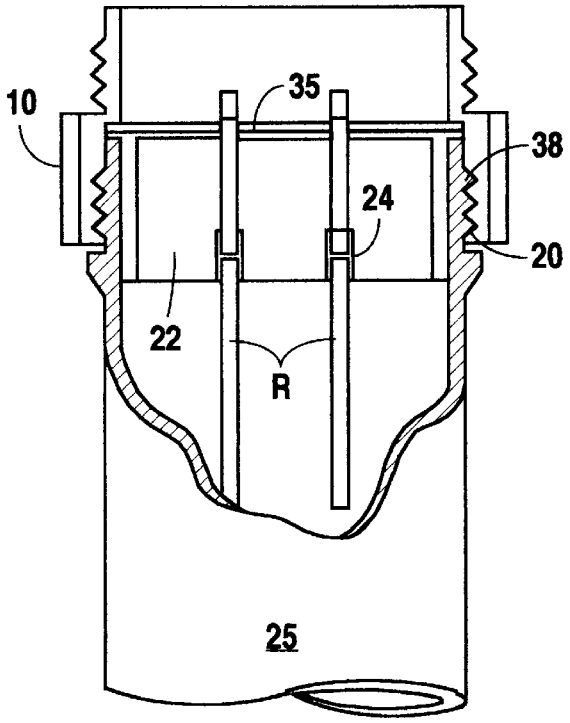
Figure 5:
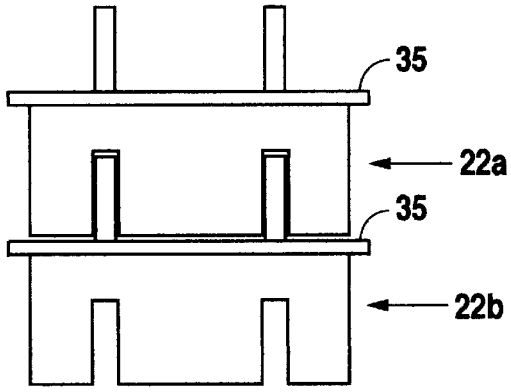

The spacers and inserts are typically made of molded plastic and may come in a variety of sizes or, alternately, may be stacked one upon the other, as illustrated in FIGS. 4 and 5. FIG. 4 illustrates two spacers (11) and (10*b*) piggyback, stacked, or otherwise joined together.

FIG. 5 illustrates how two inserts (22*a*) and (22*b*), may be stacked for insertion between the stem and the head body of a sprinkler when two spacers are used.

Figure 6A:
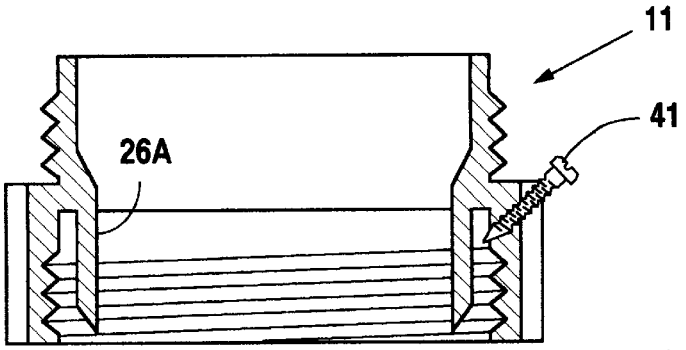
FIGS. 6A and 6B are a side elevational cross section and atop elevational view, respectively, of another preferred embodiment of Applicant's present invention.
Figure 6B:
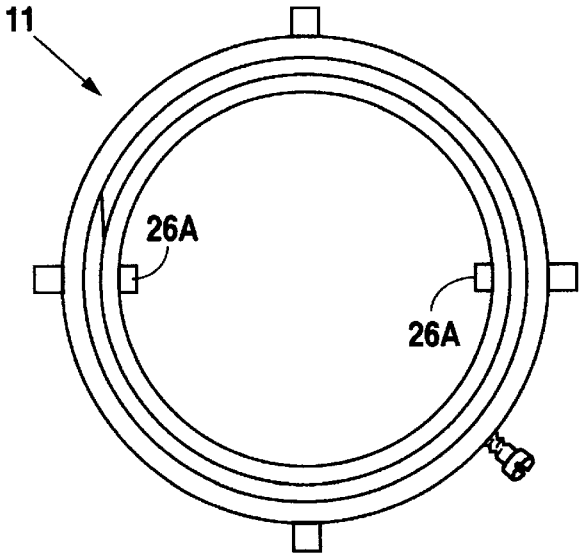
Figure 8:
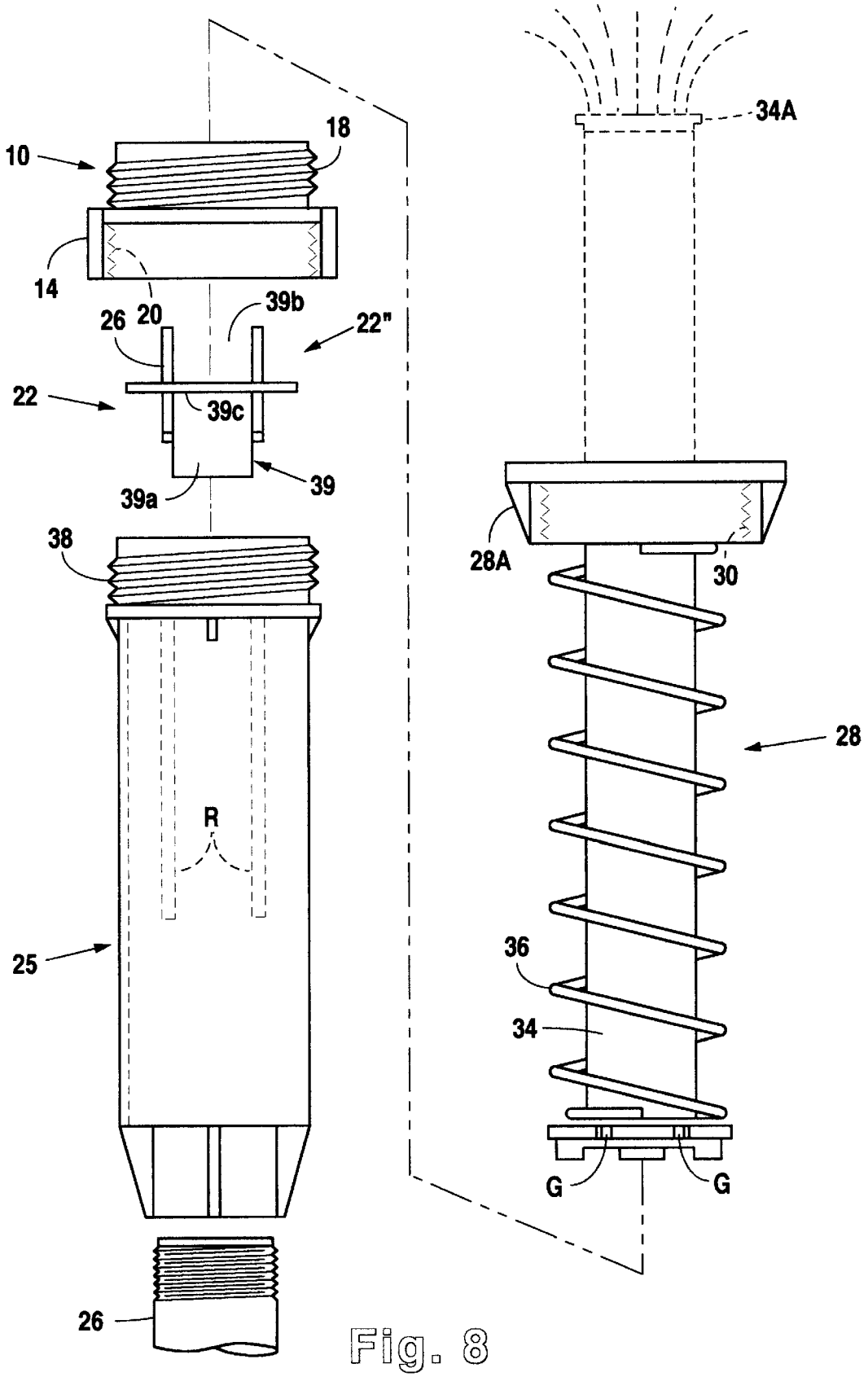
FIG. 8 is exploded view of the spacer and another preferred embodiment of Applicant's insert of the present invention as it joins the sprinkler head body and sprinkler head stem to elevate the head of the sprinkler above the sprinkler head body.
Figure 9A:
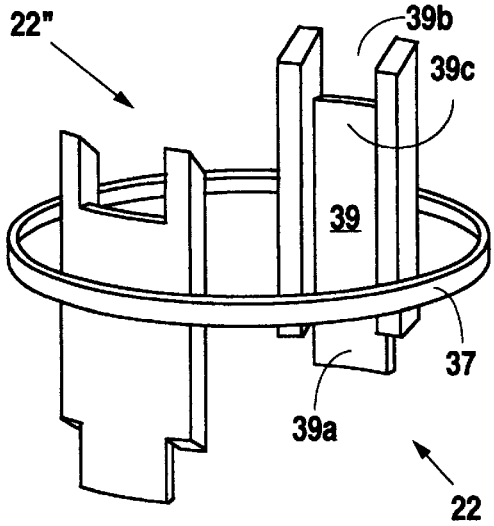
FIGS. 9A, 9B, 9C, 9D, and 9E are perspective, side cross section, top, bottom and side elevational views, respectively, of another preferred embodiment of Applicant's insert for use with Applicant's present invention.
Figure 9B:
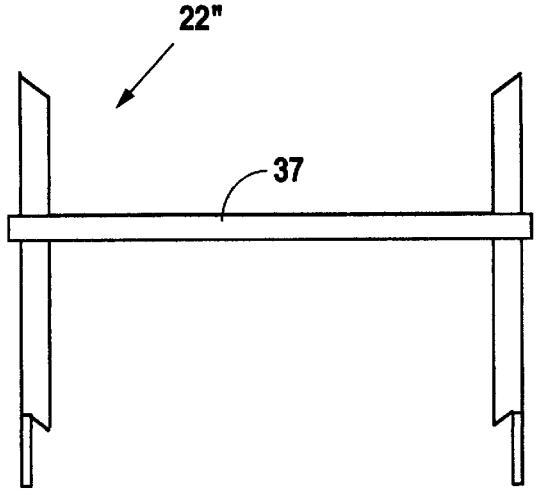
Figure 9C:
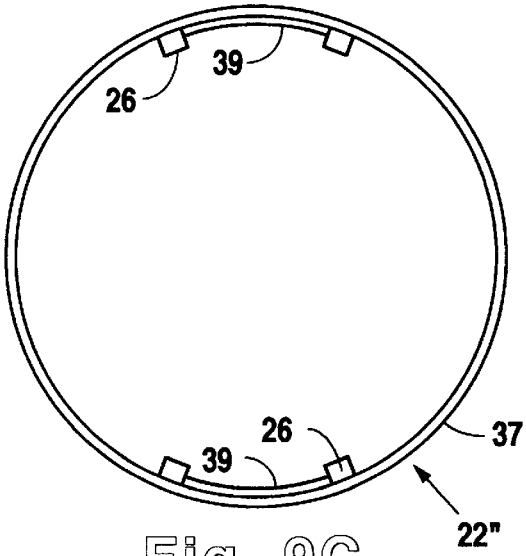
Figure 9D:
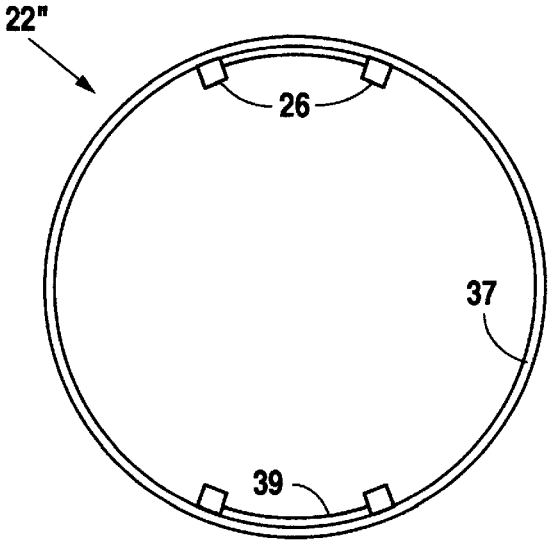
Figure 9E:
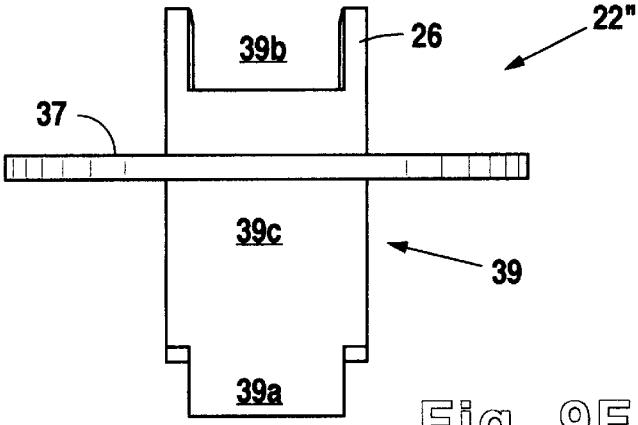
Figure 10:
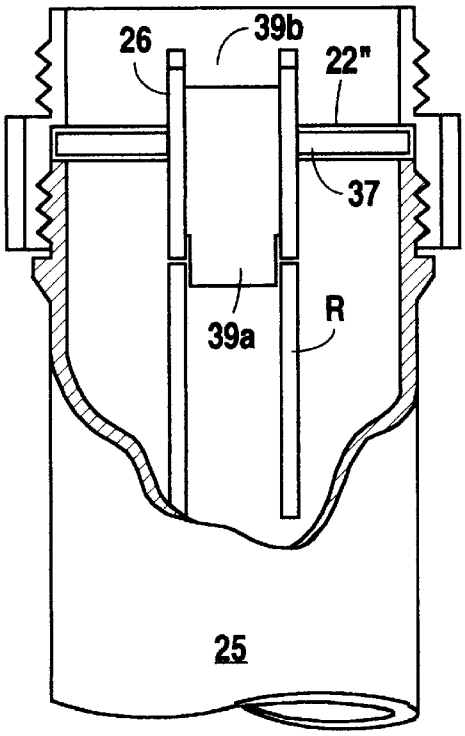
FIG. 10 is a cut away side cross sectional view of Applicant's spacer and another preferred embodiment of Applicant's insert, as installed on a sprinkler head body.

FIGS. 6A and 6B are alternate preferred embodiments of a spacer (11) that has incorporated integrally with it guide ridges (26*a*) and includes a set screw (41). The manner in which the unitary cylindrical spacer with guide ridges is utilized is by screwing it down onto the top of the sprinkler head body just as the other spacers. In other words, cylindrical spacers (11) are threaded down onto the top of the sprinkler head body; but, instead of threading it down tightly, it is threaded down tightly and then backed off until guide ridges (26*a*) align with ridges (R) on the inside surface of the sprinkler head body. At that point, set screw (41) is threaded down until it asserts pressure on threads (38). Now there is proper alignment for the stem member to slide all the way up through the head body and the spacer and still stay on the ridges with proper alignment.

Figure 7:
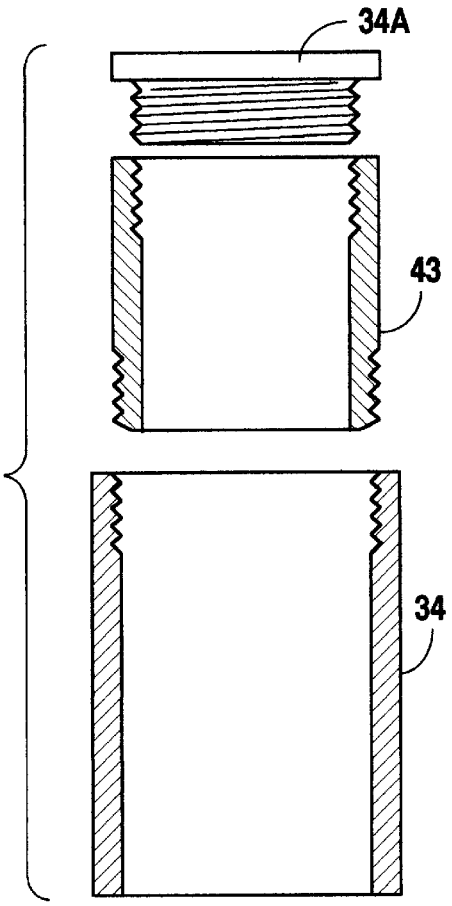
FIG. 7 is a side elevational view of the stem member and nozzle with Applicant's stem member spacer installed.

FIG. 7 illustrates an additional feature of Applicant's invention, namely, a stem member spacer (43) for insertion between nozzle (34*a*) of the stem and stem member (34). Typically, the nozzle screws directly into the top of the stem member, as set forth in FIG. 3. However, additional stem spacer (43) may be used, typically ½" in length, to create additional elevation for the nozzle.

It is anticipated that Applicant's invention may be sold as a kit, with several spacers and (for appropriate models of sprinkler heads) several stackable inserts. It can be seen with reference to the figures that Applicant provides for a cylindrical spacer with a threaded first end for engaging the head of the sprinkler and a threaded second end to separate, at a fixed nonadjustable distance, the body of the sprinkler from the head of the sprinkler to increase the distance between the extended position of the head when the extensible means extends under pressure to water the lawn and the retracted position.

Applicant provides in FIGS. 2A', 2B', 2C',2D',2E',3A' and 5' a first preferred embodiment of an insert for use with Applicant's present invention. Additionally, in FIGS. 8, 9A, 9C, 9D, 9E, 10 and 11 Applicant provides a second preferred embodiment of an insert for use with Applicant's present invention.

Both of the preferred embodiments of Applicant's insert 22 have means to prevent the insert from sliding longitudinally up or down the inside of interior of body 25. Means include, with respect to the first of the preferred embodiments, flange 35 extending outward from the upper edge of insert body 21 as seen in FIGS. 2A' through 2E'. FIG. 3' illustrates how insert 22', having flange 35 thereon fits between the top of head body 25 and the bottom of spacer 10. When spacer 10 is screwed on and insert 22' is in place, flange 35 will be sandwiched between the lower rim of the spacer and the upper rim of the body. This is illustrated in FIG. 3A' and the groove 24 aligns with ridge 26. Note that insert 22' must be placed on the body before spacer 10 is screwed on.

Figure 11:
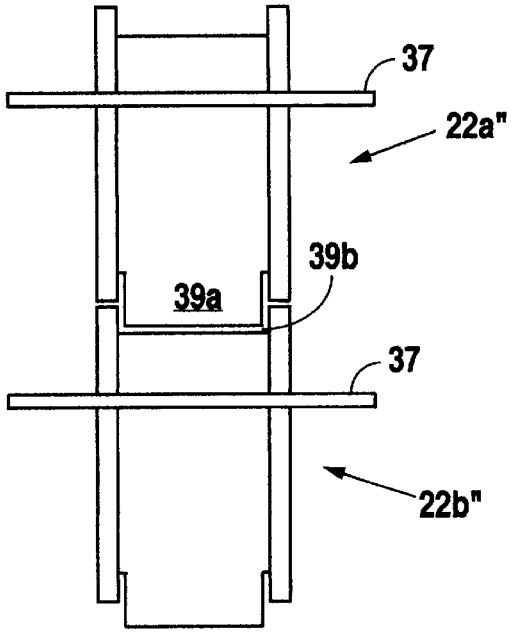
FIG. 11 is a side elevational view of a multiplicity of preferred embodiments of Applicant's inserts stacked together for insertion into the spacers of FIG. 4.

FIGS. 8, 9A, 9B, 9C, 9D, 9E, 10 and 11 illustrate a second preferred embodiment of Applicant's insert here, insert 22". Applicant's insert 22" is seen to comprise ring 37 to which is attached a pair of bodies 39 to the inside face of ring 37. Bodies 39 are integral with and include ridges 26 and include locking portion 39A extending below the lower tip of a pair of ridges as well as a cutout portion 39B which is created when the ridges extend above central portion 39C of body 39. Thus, it is seen with reference FIG. 8, and FIG. 10 how insert 22" may be placed or sandwiched between the upper portion of body 25 and spacer 10 when the spacer is screwed on. It is seen that locking portion 39A is dimensioned to fit snugly between the inner edges of the top of the ridges that are located on the inside surface of the upper portion of body 25 or, inserts 22" may be stacked as in FIG. 11 illustrating the stacking of two such inserts 22A" and 22B". In this case, locking portion 39A of 22A" will fit into cut portion 39B of insert 22B". It is also seen how ring 37 will be sandwiched between the upper perimeter or rim of body 39 and the lower perimeter or rim of spacer 10, or, when inserts are used in stack formation as in FIG. 11 (two or more inserts are used stacked) where ring 37, for stacking above the head would be sandwiched between a pair of spacers.

Therefore, Applicant has provided two preferred embodiments of an insert that will slide longitudinally on the inside surface of the body and extensions when water is applied to the system or when the sprinkler elevates above the body as when water pressures apply to the system.

Terms such as "left," "right," "up," "down," "bottom," "top," "front," "back," "in," "out," and like are applicable to the embodiments shown and described in conjunction with the drawings. These terms are merely for purposes of description and do not necessarily apply to the position or manner in which the invention may be constructed for use.

Although the invention has been described in connection with the preferred embodiment, it is not intended to limit the invention's particular form set forth, but on the contrary, it is intended to cover such alternatives, modifications, and equivalences that may be included in the spirit and scope of the invention as defined by the appended claims.

What is claimed is:

1. A device for fitting to a sprinkler head for distributing water to a lawn, the sprinkler head having a head body with alignment ridges on the interior thereof and with a first end, the first end for attaching to an underground water supply pipe and a threaded second end, the sprinkler having a stem with a stem member, the stem member having a nozzle, the stem for threadably attaching to the second end of the head body, the head body for carrying water, under pressure, from the underground water supply pipe to the stem member, the stem member for releasing the water through the nozzle to the lawn, the stem member extending from a retracted position within the head body of the sprinkler to an extended position above the head body of the sprinkler, the device comprising:

a cylindrical spacer having a threaded first end for threadably engaging the second end of the head body of the sprinkler, said cylindrical spacer having a threaded second end to separate, at a fixed and nonadjustable distance, the head body of the sprinkler from the stem of the sprinkler, and an insert, having alignment ridges and including means cooperating with the cylindrical spacer and the head to prevent the longitudinal sliding of the insert on the interior of the head body, for maintaining alignment of the stem member with respect to the head body as the stem member moves between the extended and retracted positions.

2. The device of claim 1 wherein the insert includes a cylindrical body dimensioned for receipt substantially within the head body, the body including the alignment ridges, the body having an outwardly protuding flange along a perimeter thereof.

3. The device of claim 1 wherein the insert includes a ring, the ring for engaging the alignment ridges, the ring having an interior diameter at least equal to the interior diameter of the head body.

4. The device of claim 1 wherein the insert is capable of engagement with the alignment ridges of the head body.

5. The device of claim 1, wherein said first cylindrical spacer includes means engageable with the alignment ridges of the head body to maintain alignment of the stem as it moves between an extended and retracted position.

6. A kit for retrofitting to a sprinkler head, the sprinkler head having a head body with a first end, the first end for attaching to an underground water supply pipe and a threaded second end, the sprinkler having a stem with a stem member having a nozzle therein for carrying water, under pressure, from the underground water supply pipe for distributing through the nozzle to the lawn, the stem member for extending, from a retracted position, the head body of the sprinkler to an extended position above the head body of the sprinkler, the kit including:

a multiplicity of cylindrical spacers, each having a body portion, a threaded first end, and a threaded second end, such that two or more of the multiplicity of spacers may threadably engage one another creating a spacer unit with a first end for engaging the head body of the sprinkler and a second end for engaging the stem of the sprinkler so as to increase the distance between the stem of the head and the head body; and further comprising a multiplicity of inserts engageable with said spacer unit of said multiplicity of spacers to engage the stem member to guide the stem member as it moves between the retracted and the extended position the inserts including means cooperating with a cylindrical spacer and the head body to prevent the longitudinal sliding of the insert with respect to the head body.

* * * * *